US009511612B2

(12) United States Patent
Noguchi et al.

(10) Patent No.: US 9,511,612 B2
(45) Date of Patent: Dec. 6, 2016

(54) RECORDING MEDIUM

(71) Applicant: CANON KABUSHIKI KAISHA, Tokyo (JP)

(72) Inventors: Tetsuro Noguchi, Hachioji (JP); Yasuhiro Nito, Inagi (JP); Kazuhiko Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/558,962

(22) Filed: Dec. 3, 2014

(65) Prior Publication Data

US 2015/0174936 A1 Jun. 25, 2015

(30) Foreign Application Priority Data

Dec. 24, 2013 (JP) ..... 2013-265293
Jun. 17, 2014 (JP) ..... 2014-124453

(51) Int. Cl.
*B41M 5/50* (2006.01)
*B41M 5/52* (2006.01)

(52) U.S. Cl.
CPC ..... *B41M 5/50* (2013.01); *B41M 5/502* (2013.01); *B41M 5/506* (2013.01); *B41M 5/508* (2013.01); *B41M 5/5218* (2013.01); *B41M 2205/40* (2013.01)

(58) Field of Classification Search
CPC ..... B41M 5/50; B41M 5/506; B41M 5/508; B41M 5/5218
See application file for complete search history.

(56) References Cited

U.S. PATENT DOCUMENTS

| | | | | |
|---|---|---|---|---|
| 6,357,871 | B1 * | 3/2002 | Ashida et al. | 347/106 |
| 6,874,881 | B2 | 4/2005 | Suzuki et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,635,182 | B2 | 12/2009 | Hakamada et al. | |
| 7,846,516 | B2 | 12/2010 | Kamo et al. | |
| 8,016,406 | B2 | 9/2011 | Hakamada et al. | |
| 8,252,392 | B2 | 8/2012 | Oguri et al. | |
| 8,486,499 | B2 | 7/2013 | Nito et al. | |
| 8,524,336 | B2 | 9/2013 | Oguri et al. | |
| 8,609,209 | B2 | 12/2013 | Taguri et al. | |
| 8,795,798 | B2 | 8/2014 | Oguri et al. | |
| 8,846,166 | B2 | 9/2014 | Herlambang et al. | |
| 2003/0203133 | A1 * | 10/2003 | Maekawa | 428/32.1 |
| 2005/0142305 | A1 | 6/2005 | Kobayashi et al. | |
| 2006/0045998 | A1 | 3/2006 | Kitamura et al. | |
| 2006/0216443 | A1 * | 9/2006 | Kinoshita | B41M 5/502 428/32.24 |
| 2008/0057190 | A1 | 3/2008 | Kobayashi et al. | |
| 2008/0152827 | A1 | 6/2008 | Hakamada et al. | |
| 2009/0214805 | A1 | 8/2009 | Kobayashi | |
| 2009/0324857 | A1 | 12/2009 | Okuda et al. | |
| 2011/0293860 | A1 | 12/2011 | Oguri et al. | |

FOREIGN PATENT DOCUMENTS

| | | | |
|---|---|---|---|
| CN | 1613659 | A | 5/2005 |
| CN | 1729105 | A | 2/2006 |
| CN | 101612848 | A | 12/2009 |
| CN | 102294907 | A | 12/2011 |
| EP | 2 390 105 | A1 | 11/2011 |
| JP | 7-076162 | A | 3/1995 |
| JP | 7-101142 | A | 4/1995 |
| JP | 2000-247022 | A | 9/2000 |
| JP | 2007-136777 | A | 6/2007 |
| JP | 2009-151906 | A | 7/2009 |

OTHER PUBLICATIONS

Esin Gulari, et al., "Photon correlation spectroscopy of partcile distributions," J. Chem. Phys. 70(B), Apr. 1979, pp. 3965-3972.
Polymer Structure (2); Scattering Experiments and Morphological Observation; the First Chapter: Light Scattering (Kyoritsu Shuppan, edited by the Society of Polymer Science, Japan), pp. 126-127.
Feb. 13, 2015 European Search Report in European Patent Appln. No. 14004137.7.
Sep. 28, 2016 Chinese Official Action in Chinese Patent Appin. No. 201410818475.1.

* cited by examiner

*Primary Examiner* — Betelhem Shewareged
(74) *Attorney, Agent, or Firm* — Fitzpatrick, Cella, Harper & Scinto

(57) ABSTRACT

A recording medium including, in the following order, a base, an ink-receiving layer containing inorganic particles, and a protective layer. The protective layer contains colloidal silica, gas phase process silica, and at least one kind of particles selected from resin particles and wet process silica particles. The average particle size of the at least one kind of particles is 1.5 μm or more.

7 Claims, No Drawings

RECORDING MEDIUM

BACKGROUND OF THE INVENTION

Field of the Invention

The present invention relates to a recording medium.

Description of the Related Art

As an ink-receiving layer of an ink jet recording medium, a void-type receiving layer in which porous inorganic particles such as gas phase process silica or alumina hydrate particles are bound with a binder such as polyvinyl alcohol has been widely used (Japanese Patent Application Laid-Open No. H07-076162, Japanese Patent Application Laid-Open No. 2000-247022, Japanese Patent Application Laid-Open No. H07-101142, and Japanese Patent Application Laid-Open No. 2007-136777).

In Japanese Patent Application Laid-Open No. H07-076162, there is proposed an ink jet recording material in which a silica gel layer formed of colloidal silica and a water-soluble binder is formed on an alumina hydrate receiving layer having a boehmite structure. In addition, in Japanese Patent Application Laid-Open No. 2000-247022, there is proposed a recording medium in which a porous layer formed of colloidal silica and a resin emulsion is formed on an alumina hydrate receiving layer having a boehmite structure. In addition, in Japanese Patent Application Laid-Open No. H07-101142, there is proposed an ink jet recording sheet in which a layer formed of colloid particles and polymer latex is formed. In addition, in Japanese Patent Application Laid-Open No. 2007-136777, there is proposed an ink jet recording sheet in which a protective layer formed of a fine pigment and a binder is formed.

However, studies made by the inventors of the present invention have revealed that, although the recording media described in the above-mentioned patent documents have been improved in ink absorbency, scratch resistance, and color developability of an image to be obtained, these properties thereof have not reached levels required in recent years.

Therefore, an object of the present invention is to provide a recording medium having high levels of ink absorbency, scratch resistance, and color developability of an image to be obtained.

SUMMARY OF THE INVENTION

According to an embodiment of the present invention, there is provided a recording medium, including in the following order, a base; an ink-receiving layer containing inorganic particles; and a protective layer, in which the protective layer contains colloidal silica; gas phase process silica; and at least one kind of particles selected from resin particles and wet process silica particles, and in which an average particle size of the at least one kind of particles is 1.5 μm or more.

Further features of the present invention will become apparent from the following description of exemplary embodiments.

DESCRIPTION OF THE EMBODIMENTS

The present invention is described in detail below.

Recording Medium

A recording medium of the present invention includes, in the following order, a base; an ink-receiving layer containing inorganic particles; and a protective layer. It is preferred that the recording medium of the present invention be used as a recording medium for use in a recording method of an ink jet system, that is, as an ink jet recording medium. In addition, the recording medium of the present invention may include another layer between the base and the ink-receiving layer, or between the ink-receiving layer and the protective layer. Further, the recording medium of the present invention may include still another layer on the protective layer as long as the effects of the present invention are obtained. In the present invention, it is preferred that the protective layer serve as an outermost surface layer of the recording medium.

Protective Layer

The protective layer included in the recording medium of the present invention contains colloidal silica; gas phase process silica; and at least one kind of particles (hereinafter sometimes referred to as "roughening particles") selected from resin particles and wet process silica particles, the at least one kind of particles having an average particle size of 1.5 μm or more. When the protective layer contains those components, there can be provided a recording medium capable of simultaneously having high levels of ink absorbency, color developability of an image to be obtained, and scratch resistance.

The colloidal silica has an improving effect on the scratch resistance. However, the colloidal silica tends to be easily close-packed, hardly causing void formation, and hence is liable to reduce the ink absorbency. Accordingly, when the gas phase process silica is mixed with the colloidal silica to facilitate void formation, the ink absorbency of the protective layer is improved. In addition, when the roughening particles having an average particle size of 1.5 μm or more are scattered in a layer formed by the colloidal silica and the gas phase process silica so as to form protrusions on the protective layer, the surface contact area can be reduced. Thus, the scratch resistance can be further improved without reducing the color developability of an image. In this case, when the average particle size of the roughening particles is less than 1.5 μm, the improving effect on the scratch resistance is not sufficiently obtained.

The dry coating amount of the protective layer is preferably 0.05 $g/m^2$ or more and 3.0 $g/m^2$ or less, more preferably 0.1 $g/m^2$ or more and 1.0 $g/m^2$ or less. When the protective layer satisfies a dry coating amount of 0.05 $g/m^2$ or more and 3.0 $g/m^2$ or less, the scratch resistance of the protective layer can be improved while a reduction in ink absorbency of the protective layer is prevented.

The thickness of the protective layer means the thickness of the protective layer excluding the protrusions formed by the roughening particles, and is preferably 1 μm or less, more preferably 0.5 μm or less. When the thickness of the protective layer excluding the protrusions formed by the roughening particles is 1 μm or less, the protrusions formed by the roughening particles can efficiently improve the scratch resistance, and a protective layer having satisfactory ink absorbency can be obtained.

The thickness of the protective layer excluding the protrusions formed by the roughening particles described above may be calculated from the average value of results of measurement for the thickness with a scanning electron microscope at ten points of the protective layer excluding the protrusions formed by the roughening particles and the vicinity of the protrusions, the measurement being performed for a vertical cross-section of the recording medium cut out with a rotary microtome.

It is preferred from the viewpoints of the scratch resistance and film formability that the protective layer further contain a binder. It is particularly preferred from the viewpoints of the adhesive property and transparency of a coating film that the binder be polyvinyl alcohol. The polyvinyl alcohol may be synthesized by, for example, hydrolyzing polyvinyl acetate. Examples of the polyvinyl alcohol include "PVA-417" and "PVA-420" (both of which are trade names) manufactured by KURARAY CO., LTD.

The content of the polyvinyl alcohol in the protective layer is preferably 3 mass % or more and 40 mass % or less, more preferably 5 mass % or more and 30 mass % or less with respect to the total content of the colloidal silica and the gas phase process silica. When the content of the polyvinyl alcohol is 3 mass % or more, high strength of a coating film can be easily obtained. When the content of the polyvinyl alcohol is 40 mass % or less, a reduction in color developability of an image to be obtained is suppressed, and high ink absorbency can be easily obtained.

The polyvinyl alcohol preferably has a saponification degree of 75 mol % or more and 85 mol % or less. When the saponification degree is 75 mol % or more, water solubility is less liable to be reduced, and handling characteristics become satisfactory. When the saponification degree is 85 mol % or less, aggregation hardly occurs at the time of the application of a protective layer coating liquid, and a reduction in color developability of an image to be obtained is effectively suppressed. In addition, the polyvinyl alcohol preferably has an average polymerization degree of 1,500 or more and 2,200 or less. When the average polymerization degree is 1,500 or more, a reduction in strength of a coating film is more efficiently suppressed. When the average polymerization degree is 2,200 or less, a reduction in color developability of an image to be obtained can be more efficiently suppressed. It should be noted that, in the present invention, the saponification degree of the polyvinyl alcohol refers to a value measured by a method of JIS-K6726. In terms of chemical properties, the saponification degree of the polyvinyl alcohol refers to a ratio of the number of moles of hydroxy groups generated through a saponification reaction in the preparation of the polyvinyl alcohol by the saponification of polyvinyl acetate. In addition, the average polymerization degree of the polyvinyl alcohol refers to a viscosity-average polymerization degree determined by a method described in JIS-K6726 (1994).

In the present invention, it is preferred from the viewpoints of the transparency and water resistance of a coating film that the protective layer contain cationic polyurethane particles having an average particle size of 10 nm or more and 100 nm or less (hereinafter sometimes referred to simply as "cationic polyurethane particles") in addition to the polyvinyl alcohol.

The content of the cationic polyurethane particles in the protective layer is preferably 3 mass % or more and 40 mass % or less, more preferably 5 mass % or more and 20 mass % or less with respect to the total content of the colloidal silica and the gas phase process silica.

The average particle size of the cationic polyurethane particles is more preferably 10 nm or more and 70 nm or less.

The average particle size of the cationic polyurethane particles refers to an average particle size determined through measurement by a dynamic light scattering method, followed by analysis using a cumulant method described in "Polymer Structure (2); Scattering Experiments and Morphological Observation; First Chapter: Light Scattering" (KYORITSU SHUPPAN CO., LTD., edited by The Society of Polymer Science, Japan), or J. Chem. Phys., 70(B), 15 Apl., 3965 (1979).

Examples of the cationic polyurethane particles to be suitably used in the present invention include "SUPERFLEX 600", "SUPERFLEX 610", "SUPERFLEX 620", and "SUPERFLEX 650" (trade names) manufactured by DAI-ICHI KOGYO SEIYAKU CO., LTD., and "HYDRAN CP-7030", "HYDRAN CP-7050", and "HYDRAN CP-7060" (trade names) manufactured by DIC Corporation.

Colloidal Silica

In the present invention, the protective layer contains colloidal silica. Among colloidal silicas, monodispersed colloidal silica, in particular, monodispersed spherical colloidal silica is preferred from the viewpoints of the transparency of a coating film and the scratch resistance. The term "monodispersed" means that a plurality of particles are present in the form of primary particles in a dispersion liquid without being aggregated. In addition, the term "spherical" means that, when a cross-section of the recording medium is photographed using a scanning electron microscope, and the major axis a and the minor axis b (each of which is an average value) of arbitrarily selected particles (50 or more and 100 or less particles) are determined, the ratio b/a of the minor axis to the major axis falls within the range of from 0.80 or more to 1.00 or less. The ratio b/a of the minor axis to the major axis is preferably 0.90 or more and 1.00 or less, more preferably 0.95 or more and 1.00 or less.

In addition, it is preferred from the viewpoints of the application property and water resistance of a coating film that the colloidal silica be cationic. The cationic colloidal silica may be prepared by causing the surface of general anionic colloidal silica to become cationic through surface treatment using an organic or inorganic treatment agent. Examples of the organic or inorganic treatment agent include various silane coupling agents and aluminum compounds. From the viewpoints of the stability of a dispersion liquid and easy availability, cationic colloidal silica that has been coated with alumina through surface treatment with an aluminum compound is preferred.

Examples of the monodispersed spherical cationic colloidal silica include "SNOWTEX AK-L" manufactured by Nissan Chemical Industries, Ltd. and "Cartacoat K303C" manufactured by Clariant Co., Ltd. (trade names, both of which are provided as a sol).

The colloidal silica has an average particle size $d_A$ of preferably 20 nm or more and 100 nm or less, more preferably 30 nm or more and 60 nm or less. When the average particle size $d_A$ is 20 nm or more, the ink absorbency is hardly reduced. When the average particle size $d_A$ is 60 nm or less, the transparency of a coating film is hardly reduced, and hence a reduction in color developability of an image to be obtained is particularly suppressed. In addition, the average particle size of the colloidal silica refers to an average diameter calculated from the average value of the major axis a and the minor axis b of each particle measured based on a photograph of particles taken using a scanning electron microscope (50 or more and 100 or less particles are observed), and thus refers to an average primary particle size.

Gas Phase Process Silica

In the present invention, the protective layer contains gas phase process silica. The gas phase process silica generally refers to silica produced by burning silicon tetrachloride, hydrogen, and oxygen, and is sometimes called dry silica or fumed silica. Primary particles of the gas phase process silica are bound to form a secondary particle in a cluster form. From the viewpoints of the ink absorbency, the color developability of an image to be obtained, and the prevention of a crack at the time of application and drying, the gas phase process silica to be used in the present invention preferably has a specific surface area determined by a BET method of 50 $m^2/g$ or more and 400 $m^2/g$ or less, more preferably 200 $m^2/g$ or more and 350 $m^2/g$ or less. In addition, in the present invention, the gas phase process silica preferably has an average primary particle size of 3 nm or more and less than 20 nm. The average primary particle size of the gas phase process silica is calculated from the average value of the diameters of arbitrarily selected (50 or more and 1,000 or less) gas phase process silica particles measured based on a photograph of a cross-section of the recording medium taken using a scanning electron microscope. Further, it is preferred from the viewpoint of achieving both of the ink absorbency and the color developability of an image to be obtained that the gas phase process silica have an average secondary particle size of 100 nm or more and 300 nm or less in terms of average secondary particle size determined using a laser particle size analyzer based on a dynamic light scattering method.

It should be noted that the BET method is one of the methods of measuring the surface area of powder based on a gas phase adsorption method, and is a method of determining the total surface area of 1 g of a sample, i.e., a specific surface area from an adsorption isotherm. In the BET method, in general, a method involving using a nitrogen gas as an adsorbate gas, and measuring an adsorption amount based on a change in pressure or volume of the adsorbate gas is most often used. In this context, the most famous expression of an isotherm of multimolecular adsorption is the Brunauer-Emmett-Teller equation, which is called "BET equation" and widely used in the determination of a specific surface area. In the BET method, the adsorption amount is determined based on the BET equation, and is multiplied by an occupation area of one adsorbed molecule in the surface, to thereby obtain the specific surface area. In the BET method, in measurement by a nitrogen adsorption-desorption method, the relationship of the adsorption amount to a certain relative pressure is measured at several points, and the slope and intercept of plotting of the measurement are determined by the method of least squares, to thereby derive the specific surface area.

A specific example of the gas phase process silica may be commercially available gas phase process silica (e.g., trade name: "AEROSIL 300", manufactured by EVONIK Co., $S_B$=300±30 $m^2/g$).

The content of the colloidal silica in the protective layer is preferably 1 times or more and 19 times or less as much as the content of the gas phase process silica in terms of mass ratio from the viewpoint of a balance between the scratch resistance and the ink absorbency, more preferably 1.5 times or more and 9.0 times or less.

The gas phase process silica may be used in the form of a dispersion liquid by being dispersed through mixing with a dispersant and a mordant such as a cationic resin or a polyvalent metal salt. The form of the dispersion liquid is referred to as gas phase process silica sol. It should be noted that the gas phase process silica sol may contain, as required, an additive such as a surface modifier such as a silane coupling agent; a thickener; a fluidity improver; an antifoaming agent; a foam inhibitor; a surfactant; a release agent; a penetrant; a color pigment; a color dye; a fluorescent whitening agent; a UV absorber; an antioxidant; an antiseptic agent; an antifungal agent; a water resistant additive; a cross-linking agent; or a weatherproofing material.

Water, an organic solvent, or a mixed solvent thereof may be used as a dispersion medium for the gas phase process silica sol. Of those, water is preferred as the dispersion medium.

After the mixing of the gas phase process silica with the dispersant and the mordant, particles may be made finer using a disperser, to thereby obtain a gas phase process silica sol having dispersed therein gas phase process silica having an average secondary particle size of 100 nm or more and 300 nm or less. As the disperser, various known dispersers such as a high speed rotation disperser, a medium stirring-type disperser (such as a ball mill or a sand mill), an ultrasonic disperser, a colloid mill disperser, and a high-pressure homogenizer may be used.

Roughening Particles Having Average Particle Size of 1.5 μm or More

In the present invention, the protective layer contains at least one kind of particles selected from resin particles and wet process silica particles, the at least one kind of particles having an average particle size of 1.5 μm or more.

The average particle size of the roughening particles needs to be 1.5 μm or more. When the average particle size is less than 1.5 μm, it becomes difficult to satisfy the scratch resistance as well as excellent ink absorbency in the case of using the colloidal silica and the gas phase process silica in combination. The average particle size of the roughening particles is preferably 1.5 μm or more and 30 μm or less, more preferably 2 μm or more and 30 μm or less, particularly preferably 3 μm or more and 15 μm or less. When the average particle size of the roughening particles is 1.5 μm or more and 30 μm or less, the roughening particles can be effectively prevented from being removed from the protective layer, and the scratch resistance can be effectively improved.

It is preferred from the viewpoint of the scratch resistance that the dry coating amount of the roughening particles contained in the protective layer be 0.001 $g/m^2$ or more and 0.05 $g/m^2$ or less. The dry coating amount of the roughening particles is more preferably 0.003 $g/m^2$ or more and 0.02 $g/m^2$ or less.

Examples of the resin particles may include resin particles of thermoplastic resins including various thermoplastic elastomers, such as poly(meth)acrylate, polystyrene, polycarbonate, poly(meth)acrylic acid, starch, polyethylene, a fluororesin, a polyester resin, a butyral resin, a polyphenylene oxide resin, a polyvinyl chloride resin, a vinyl acetate resin, and a silicone rubber, a urethane resin, a melamine resin, a silicon resin, a polyamide resin, a phenol resin, an epoxy resin, and an unsaturated polyester resin; and resin particles of copolymers thereof. In particular, resin particles of thermoplastic resins such as polymethyl methacrylate, polystyrene, and polyethylene are preferred. As the resin particles of those thermoplastic resins, it is more preferred to use a cross-linked type excellent in weather resistance and solvent resistance. In the present invention, the average particle size of the resin particles means a sphere equivalent particle diameter measured by a pore electrical resistance method based on the Coulter principle. The average particle size may be measured using, for example, "Multisizer 3" (trade name, manufactured by Beckman Coulter, Inc.).

Examples of the wet process silica include precipitation process silica and gel process silica. The precipitation process silica is produced through a reaction of sodium silicate and sulfuric acid under an alkaline condition. Silica particles that have undergone particle growth during the production process are aggregated and precipitated, and are then subjected to the steps of filtration, water washing, drying, pulverization, and classification to become a finished product. A secondary particle of silica produced by this method is a loosely aggregated particle, and thus a relatively easy-to-pulverize particle is obtained. The precipitation process silica is commercially available, for example, from TOSOH SILICA CORPORATION under the name of Nipsil, or from Tokuyama Corporation under the name of TOKUSIL or FINESIL. The gel process silica is produced through a reaction of sodium silicate and sulfuric acid under an acidic condition. In this case, small silica particles are dissolved during aging, and are reprecipitated between primary particles having large particle sizes so as to bind the primary particles together. Thus, definite primary particles disappear, and a relatively hard aggregated particle having an internal void structure is formed. For example, the gel process silica is commercially available from Mizusawa Industrial Chemicals, Ltd. under the name of MIZUKASIL, or from Grace Japan under the name of SYLOJET. In the present invention, the average particle size (average secondary particle size) of the wet process silica is calculated from the average value of the diameters of arbitrarily selected (50 or more and 1,000 or less) wet process silica particles measured based on a photograph of a cross-section of the recording medium taken using a scanning electron microscope.

Other Components

In addition, the protective layer may contain various additives such as a thickener, an antifoaming agent, a dot adjuster, an antiseptic agent, a pH adjuster, an antistatic agent, and a conductive agent.

Method of Producing Protective Layer

The protective layer may be produced by preparing a protective layer coating liquid and applying the liquid. The application may be performed when the ink-receiving layer is in any of a wet state and a dry state. As a method of applying the protective layer coating liquid, for example, an air knife coating method, a gravure coating method, a blade coating method, a bar coating method, a roll coating method, a rod bar coating method, a slot die coating method, a curtain coating method, or a size press method may be used.

Ink-Receiving Layer

The ink-receiving layer to be used in the present invention contains inorganic particles. It is preferred from the viewpoints of rapid absorbability, dye fixability, transparency, printing density, and the color developability to use, as the inorganic particles, at least one kind of inorganic particles selected from the group consisting of gas phase process silica, alumina hydrate, and alumina. Of those, gas phase process silica is preferably used from the viewpoint of the scratch resistance.

The dry coating amount of the ink-receiving layer is preferably 5 g/m$^2$ or more and 50 g/m$^2$ or less. When the dry coating amount of the ink-receiving layer is 5 g/m$^2$ or more, a reduction in ink absorbency can be easily suppressed. When the dry coating amount of the ink-receiving layer is 50 g/m$^2$ or less, folding crack resistance is hardly reduced.

The ink-receiving layer is obtained by preparing an ink-receiving layer coating liquid, applying it onto a base followed by drying. The ink-receiving layer coating liquid contains inorganic particles and a binder, and may contain various additives as required. Examples of the additives may include a pigment dispersing agent, a thickener, a fluidity improver, an antifoaming agent, a foam inhibitor, a surfactant, a release agent, a penetrant, a color pigment, a color dye, a fluorescent whitening agent, a UV absorber, an antioxidant, an antiseptic agent, an antifungal agent, a water resistant additive, a dye fixing agent, a curing agent, and a weatherproofing material.

A known application method may be applied as a method of applying the ink-receiving layer coating liquid onto the base. Examples thereof include a blade coating method, an air knife coating method, a curtain die coating method, a slide bead die coating method, a slot die coating method, a bar coating method, a gravure coating method, and a roll coating method.

After having been applied onto the base, the ink-receiving layer coating liquid may be dried using a drying apparatus such as a hot-air dryer, a hot drum, or a far infrared dryer, to thereby form the ink-receiving layer.

It should be noted that the ink-receiving layer may be formed on one surface or both surfaces of the base to be described later. In addition, for the purpose of improving the resolution of an image, conveyability, and the like, the ink-receiving layer may be subjected to smoothing treatment using, for example, an apparatus such as a calender or casting apparatus as long as the effects of the present invention are not impaired.

Gas Phase Process Silica

The description of the above-mentioned gas phase process silica to be used in the protective layer similarly applies to the gas phase process silica that may be used in the ink-receiving layer.

Alumina Hydrate

As the alumina hydrate that may be used in the ink-receiving layer, for example, one represented by the following general formula (X) may be suitably utilized.

$$Al_2O_{3-n}(OH)_{2n}\cdot mH_2O \quad (X)$$

(In the formula, n represents any one of 0, 1, 2, and 3, and m represents a number of 0 or more and 10 or less, preferably 0 or more and 5 or less, provided that m and n do not simultaneously represent 0.)

In many cases, $mH_2O$ represents a desorbable aqueous phase that is not involved in the formation of a crystal lattice, and hence m may represent an integer or non-integer value. In addition, when the alumina hydrate is heated, m may represent the value of 0.

As for the crystal structure of the alumina hydrate, which varies depending on a temperature at which heat treatment is performed, amorphous, gibbsite-type, and boehmite-type ones are known. Alumina hydrate having any of the crystal structures may be used. Of those, alumina hydrate that shows a boehmite structure or an amorphous structure in analysis by an X-ray diffraction method is preferably used.

In addition, the alumina hydrate has a specific surface area measured by the BET method of preferably 100 m$^2$/g or more and 200 m$^2$/g or less, more preferably 125 m$^2$/g or more and 175 m$^2$/g or less.

An example of the alumina hydrate may be "Disperal HP14" (trade name, manufactured by Sasol), which is commercially available. It should be noted that one kind of the alumina hydrates may be used alone, or two or more kinds thereof may be used in combination.

Alumina

Examples of the alumina that may be used in the ink-receiving layer may include γ-alumina, α-alumina, δ-alumina, θ-alumina, and χ-alumina. Of those, γ-alumina is preferred from the viewpoints of the color developability of an image to be obtained and the ink absorbency.

A specific example of the alumina may be commercially available gas phase process γ-alumina (e.g., trade name: "AEROXIDE Alu C", manufactured by EVONIK).

Aqueous Dispersion Liquid Containing Alumina Hydrate or Alumina

The alumina hydrate or the alumina is preferably mixed as an aqueous dispersion liquid with the ink-receiving layer coating liquid. In addition, it is preferred to use an acid (deflocculating acid) as a dispersant to be contained in the aqueous dispersion liquid.

It is preferred from the viewpoint of image blurring resistance that the deflocculating acid be a sulfonic acid represented by the following general formula [I].

$R^1—SO_3H$ General formula [I]:

In the general formula [I], $R^1$ represents a hydrogen atom, a substituted or unsubstituted linear or branched $C_{1-3}$ alkyl group, or a substituted or unsubstituted linear or branched $C_{2-3}$ alkenyl group. In this case, a substituent that the alkyl group or the alkenyl group may have is, for example, an oxo group (=O), a halogen atom, a methoxy group, an ethoxy group, a formyl group, an acetyl group, or a propionyl group, and the alkyl group or the alkenyl group may have a plurality of substituents.

The gas phase process silica, the alumina hydrate, and the alumina may be used as a mixture. For example, at least two kinds of the gas phase process silica, the alumina hydrate, and the alumina are mixed in a powder state, and then the mixture is dispersed in an appropriate dispersion medium to prepare a dispersion liquid (sol). Alternatively, powder of the gas phase process silica may be used by being added to an aqueous dispersion liquid containing the alumina hydrate or an aqueous dispersion liquid containing the alumina or being added to a mixed dispersion liquid of an aqueous dispersion liquid containing the alumina hydrate and an aqueous dispersion liquid containing the alumina.

Binder

It is preferred that the ink-receiving layer contain a binder. In the present invention, the binder means a material having an ability to bind the inorganic particles to form a film. As the binder, any hitherto known one may be used, and in particular, polyvinyl alcohol is preferably used. The polyvinyl alcohol has an average polymerization degree of preferably 1,500 or more, more preferably 2,000 or more and 5,000 or less. In addition, the polyvinyl alcohol has a saponification degree of preferably 80 mol % or more and 100 mol % or less, more preferably 85 mol % or more and 100 mol % or less. The definitions of the average polymerization degree and the saponification degree are as described above.

In addition to the foregoing, modified polyvinyl alcohol such as polyvinyl alcohol whose terminal is modified with a cation or anion-modified polyvinyl alcohol having an anionic group may be used as the binder.

Cross-Linking Agent

The ink-receiving layer may contain a cross-linking agent. Examples of the cross-linking agent include aldehyde-based compounds, melamine-based compounds, isocyanate-based compounds, zirconium-based compounds, amide-based compounds, aluminum-based compounds, and boric acid compounds or salts of boric acid compounds. One kind of the cross-linking agents may be used alone, or two or more kinds thereof may be used in combination. Of those cross-linking agents, at least one kind selected from boric acid compounds and salts of boric acid compounds is preferred from the viewpoints of cross-linking rate and prevention of a crack in a coating surface.

Examples of the boric acid compounds include orthoboric acid ($H_3BO_3$), metaboric acid ($HBO_2$), and hypoboric acid ($H_4B_2O_4$). Of those, orthoboric acid is preferred. Examples of the salts of boric acid compounds include alkali metal salts of boric acid compounds (such as $Na_2B_4O_7.10H_2O$ and $NaBO_2.4H_2O$, and $K_2B_4O_7.5H_2O$ and $KBO_2$), ammonium salts of boric acid compounds (such as $NH_4B_4O_9.3H_2O$ and $NH_4BO_2$), and alkaline earth metal salts of boric acid compounds.

In addition, it is preferred from the viewpoint of the stability of the coating liquid over time that the content of the at least one kind selected from boric acid compounds and salts of boric acid compounds in the ink-receiving layer be 10 mass % or more and 50 mass % or less with respect to the content of the binder.

Base

Examples of the base include: paper such as cast-coated paper, baryta paper, or resin-coated paper (resin-coated paper sheets having one surface or both surfaces coated with a resin such as polyolefin); a base made of a film such as a thermoplastic resin film; and a sheet made of glass, metal, or the like.

Further, in order to improve adhesive strength between any such base and the ink-receiving layer, the surface of the base may be subjected to corona discharge treatment or various kinds of undercoating treatment. Of the above-mentioned bases, resin-coated paper is preferably used from the viewpoint of the quality of the recording medium, such as glossiness, after the formation of the ink-receiving layer. The resin-coated paper is preferably polyolefin-resin-coated paper, more preferably polyolefin-resin-coated paper sheets having both surfaces coated. A preferred form of the polyolefin resin-coated paper has a ten-point average roughness according to JIS-B0601 of 0.5 μm or less and a 60° specular gloss according to JIS-Z-8741 of 25% or more and 75% or less.

The thickness of the resin-coated paper sheets is not particularly limited, but is preferably 25 μm or more and 500 μm or less. When the thickness of the resin-coated paper sheets is 25 μm or more, the prevention of a reduction in rigidity of the recording medium is facilitated, and the prevention of the occurrence of inconveniences such as the deterioration of the hand feeling and texture of the recording medium and a reduction in non-transparency is facilitated. In addition, when the thickness of the resin-coated paper sheets is 500 μm or less, the recording medium is prevented from becoming stiff, which facilitates the handling thereof, and can be fed and conveyed smoothly in a printer. The thickness of the resin-coated paper sheets is more preferably 50 μm or more and 300 μm or less. In addition, the basis weight of the resin-coated paper sheets is not particularly limited, but is preferably 25 $g/m^2$ or more and 500 $g/m^2$ or less.

EXAMPLES

The present invention is described in more detail below by way of Examples. However, the present invention is not limited to Examples below. It should be noted that an ink jet recording medium was produced in each of the following examples. It should be noted that various physical properties of commercially available products are values shown in catalogues of respective manufacturers.

Production of Base

A base was produced under the following conditions. First, a paper stock having the following composition was prepared, in which the solid content concentration was adjusted with water to 3 mass %.

Paper Stock Composition

| | |
|---|---|
| Pulp (80 parts by mass of Laubholz Bleached Kraft Pulp (LBKP) having a Canadian standard freeness (CSF) of 450 ml and 20 parts by mass of Nadelholz Bleached Kraft Pulp (NBKP) having a CSF of 480 ml) | 100 parts by mass |

-continued

| | |
|---|---|
| Cationized starch | 0.60 part by mass |
| Heavy calcium carbonate | 10 parts by mass |
| Light calcium carbonate | 15 parts by mass |
| Alkyl ketene dimer | 0.10 part by mass |
| Cationic polvacrylamide | 0.030 part by mass |

Next, the paper stock was made into paper with a Fourdrinier paper machine, and the paper was subjected to three-stage wet pressing and then dried with a multi-cylinder dryer. The dried paper was then impregnated with an aqueous solution of oxidized starch with a size press machine so as to give a dry coating amount of 1.0 g/m$^2$, and dried. After that, the resultant was subjected to machine calender finishing to obtain base paper A having a basis weight of 170 g/m$^2$, a Stöckigt sizing degree of 100 seconds, an air permeability of 50 seconds, a Bekk smoothness of 30 seconds, and a Gurley stiffness of 11.0 mN.

Twenty-five g/m$^2$ of a resin composition, which was formed of low-density polyethylene (70 parts by mass), high-density polyethylene (20 parts by mass), and titanium oxide (10 parts by mass), was applied onto the base paper A. Further, 25 g/m$^2$ of a resin composition, which was formed of high-density polyethylene (50 parts by mass) and low-density polyethylene (50 parts by mass), was applied onto the back surface of the base paper A to obtain a resin-coated base.

Preparation of Gas Phase Process Silica Sol

To 79.23 parts by mass of ion-exchanged water was added 1.54 parts by mass of a cationic resin (dimethyldiallylammonium chloride polycondensate, trade name: "SHALLOL DC902P", manufactured by DAI-ICHI KOGYO SEIYAKU CO., LTD., solid content concentration: 50 mass %) as a gas phase process silica dispersant to obtain a cationic resin aqueous solution. While the cationic resin aqueous solution was stirred with a homomixer (manufactured by Tokushu Kika Kogyo Co., Ltd., trade name: "T.K. HOMO MIXER MARK II Model 2.5") under the rotation condition of 3,000 rpm, 19.23 parts by mass of gas phase process silica (trade name: "AEROSIL 300", manufactured by EVONIK Co.) was added bit-by-bit. The mixture was further treated twice with a high-pressure homogenizer (trade name: "Nanomizer", manufactured by YOSHIDA KIKAI CO., LTD.) to prepare a gas phase process silica sol having a solid content concentration of 20 mass %.

Preparation of Alumina Hydrate Sol

To 80 parts by mass of ion-exchanged water was added 0.33 part by mass of methanesulfonic acid as an alumina hydrate deflocculating acid to obtain a methanesulfonic acid aqueous solution. While the methanesulfonic acid aqueous solution was stirred with the above-mentioned homomixer under the rotation condition of 3,000 rpm, 19.67 parts by mass of alumina hydrate (trade name: "DISPERAL HP14", manufactured by Sasol) was added bit-by-bit. The stirring was continued for 30 minutes after the completion of the addition to prepare an alumina hydrate sol having a solid content concentration of 20 mass %.

Preparation of Resin Particle Dispersion Liquid

To 80 parts by mass of ion-exchanged water was added 0.16 part by mass of polyacrylic acid as a dispersant to obtain a polyacrylic acid aqueous solution. While the polyacrylic acid aqueous solution was stirred with the above-mentioned homomixer under the rotation condition of 1,500 rpm, 19.84 parts by mass of cross-linked polymethyl methacrylate resin particles having an average particle size of 5 μm (trade name: "Techpolymer SSX-105", manufactured by SEKISUI PLASTICS CO., LTD.) was added bit-by-bit. The stirring was continued for 30 minutes after the completion of the addition to prepare a resin particle dispersion liquid having a solid content concentration of 20 mass %.

Preparation of Colloidal Silica Sol

A colloidal silica sol (manufactured by Nissan Chemical Industries, Ltd., trade name: SNOWTEX AK-L) was prepared. The colloidal silica had an average primary particle size of 50 nm.

Preparation of Precipitation Process Silica Particle Dispersion Liquid

To 80 parts by mass of ion-exchanged water was added 0.16 part by mass of polyacrylic acid as a dispersant, and the mixture was stirred with a homomixer (manufactured by Tokushu Kika Kogyo Co., Ltd., trade name: T.K. HOMO MIXER MARK II Model 2.5) under the rotation condition of 1,500 rpm. During the stirring, 19.84 parts by mass of precipitation process silica particles having an average secondary particle size of 6.2 μm (trade name: FINESIL X-60, manufactured by Tokuyama Corporation) was added bit-by-bit. The stirring was continued for 30 minutes after the completion of the addition to prepare a precipitation process silica particle dispersion liquid having a solid content concentration of 20 mass %. The precipitation process silica had an average secondary particle size of 6.2 μm.

Preparation of Ink-Receiving Layer Coating Liquid 1

The gas phase process silica sol prepared in the foregoing was mixed with an 8 mass % aqueous solution of polyvinyl alcohol (trade name: "PVA-235", manufactured by KURARAY CO., LTD.) so that the content of the polyvinyl alcohol was 20 parts by mass in terms of solid content with respect to 100 parts by mass of the solid content of the gas phase process silica contained in the sol. Next, an orthoboric acid aqueous solution having a solid content concentration of 5 mass % was added to the mixture so that the content of orthoboric acid was 20 parts by mass in terms of solid content with respect to 100 parts by mass of the solid content of the polyvinyl alcohol in the mixed liquid. Further, a surfactant (trade name: "Surfynol 465", manufactured by Nissin Chemical Industry Co., Ltd.) was added so that its concentration was 0.1 mass % to obtain an ink-receiving layer coating liquid 1.

Preparation of Ink-Receiving Layer Coating Liquid 2

The alumina hydrate sol prepared in the foregoing was mixed with the aqueous solution of polyvinyl alcohol so that the content of the polyvinyl alcohol was 10 parts by mass in terms of solid content with respect to 100 parts by mass of the solid content of the alumina hydrate contained in the sol. Next, an orthoboric acid aqueous solution having a solid content concentration of 5 mass % was added to the mixed liquid so that the content of orthoboric acid was 10 parts by mass in terms of solid content with respect to 100 parts by mass of the solid content of the polyvinyl alcohol in the mixed liquid. Then, a surfactant (trade name: "Surfynol 465", manufactured by Nissin Chemical Industry Co., Ltd.) was further added to the resultant mixed liquid so that its concentration was 0.1 mass % to obtain an ink-receiving layer coating liquid 2.

Production of Ink-Receiving Layer Coated Sheet A

The ink-receiving layer coating liquid 1 was applied onto the base so that its dry coating amount was 23 g/m$^2$. It should be noted that the application of the ink-receiving layer coating liquid 1 was performed using a slide die at a liquid temperature of the coating liquid of 40° C. Next, the resultant was dried at 45° C. to produce an ink-receiving layer coated sheet A having one ink-receiving layer containing gas phase process silica.

Production of Ink-Receiving Layer Coated Sheet B

The ink-receiving layer coating liquid 2 was applied onto the base so that its dry coating amount was 35 g/m$^2$. It should be noted that the application of the ink-receiving layer coating liquid 2 was performed using a slide die at a liquid temperature of the coating liquid of 40° C. Next, the resultant was dried at 80° C. to produce an ink-receiving layer coated sheet B having one ink-receiving layer containing alumina hydrate.

Formulation of Protective Layer Coating Liquid 1-1

The following components were mixed with each other to prepare a protective layer coating liquid 1-1 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.53 parts by mass |
| 20 mass % sol of gas phase process silica | 2.18 parts by mass |
| 20 mass % dispersion liquid of resin particles | 0.32 part by mass |
| 8 mass % aqueous solution of polyvinyl alcohol (trade name: PVA-420. manufactured by KURARAY CO., LTD.) | 2.42 parts by mass |
| Surfactant (trade name: NOIGEN TDX, manufactured by DAI- ICHI KOGYO SEIYAKU CO., LTD.) | 0.10 part by mass |
| Ion-exchanged water | 88.45 parts by mass |

Example 1-1

The protective layer coating liquid 1-1 was applied onto the ink-receiving layer of the ink-receiving layer coated sheet A with a Meyer bar, and was then dried at 60° C. Thus, an ink jet recording medium 1-1 having a dry coating amount of a protective layer of 0.31 g/m$^2$ (including a dry coating amount of the resin particles of 0.01 g/m$^2$) was obtained. In addition, the protective layer had a thickness of 0.26 μm.

Example 1-2

An ink jet recording medium 1-2 (the protective layer had a thickness of 0.26 μm) was obtained in the same manner as in Example 1-1 except that the ink-receiving layer coated sheet B was used in place of the ink-receiving layer coated sheet A.

Example 1-3

An ink jet recording medium 1-3 (having a dry coating amount of the protective layer of 0.31 g/m$^2$, including a dry coating amount of the resin particles of 0.01 g/m$^2$; the protective layer had a thickness of 0.24 μm) was obtained in the same manner as in Example 1-1 except that the protective layer coating liquid 1-1 was changed to the following protective layer coating liquid 1-2.

Formulation of Protective Layer Coating Liquid 1-2

The following components were mixed with each other to prepare a protective layer coating liquid 1-2 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 5.81 parts by mass |

-continued

| | |
|---|---|
| 20 mass % sol of gas phase process silica | 1.94 parts by mass |
| 20 mass % dispersion liquid of resin particles | 0.32 part by mass |
| 8 mass % aqueous solution of polyvinyl alcohol (trade name: PVA-420, manufactured by KURARAY CO., LTD,) | 2.42 parts by mass |
| 25 mass % emulsion of cationic polyurethane (trade name: SUPERFLEX 600, manufactured by DAI-ICHI KOGYO SEIYAKU CO., LTD.) | 0.77 part by mass |
| Surfactant (trade name: NOIGEN TDX, manufactured by DAI- ICHI KOGYO SEIYAKU CO., LTD.) | 0.10 part by mass |
| Ion-exchanged water | 88.64 parts by mass |

Example 1-4

An ink jet recording medium 1-4 (having a dry coating amount of the protective layer of 0.35 g/m$^2$, including a dry coating amount of the resin particles of 0.05 g/m$^2$; the protective layer had a thickness of 0.27 μm) was obtained in the same manner as in Example 1-1 except that the protective layer coating liquid 1-1 was changed to the following protective layer coating liquid 1-3.

Formulation of Protective Layer Coating Liquid 1-3

The following components were mixed with each other to prepare a protective layer coating liquid 1-3 having a solid content concentration of 2.0 mass %.

| | |
|---|---|
| 20 mass % sol of monodispersed spherical colloidal silica (trade name: SNONTEX AK-L, manufactured by Nissan Chemical Industries, Ltd.) | 5.79 parts by mass |
| 20 mass % sol of gas phase process silica | 1.93 parts by mass |
| 20 mass % dispersion liquid of resin particles | 1.42 parts by mass |
| 8 mass % aqueous solution of polyvinyl alcohol (trade name: PVA-420. manufactured by KURARAY CO., LTD.) | 2.15 parts by mass |
| Surfactant (trade name: NOIGEN TDX, manufactured by DAI-ICHI KOGYO SEIYAKU CO., LTD.) | 0.10 part by mass |
| Ion-exchanged water | 88.61 parts by mass |

Example 1-5

An ink jet recording medium 1-5 (having a dry coating amount of the protective layer of 0.301 g/m$^2$, including a dry coating amount of the resin particles of 0.001 g/m$^2$; the protective layer had a thickness of 0.23 μm) was obtained in the same manner as in Example 1-1 except that the protective layer coating liquid 1-1 was changed to the following protective layer coating liquid 1-4.

Formulation of Protective Layer Coating Liquid 1-4

The following components were mixed with each other to prepare a protective layer coating liquid 1-4 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.73 parts by mass |
| 20 mass % sol of gas phase process silica | 2.24 parts by mass |
| 20 mass % dispersion liquid of resin particles | 0.03 part by mass |
| 8 mass % aqueous solution of polyvinyl alcohol (trade name: PVA-420, manufactured by KURARAY CO., LTD.) | 2.49 parts by mass |

-continued

| | |
|---|---|
| Surfactant (trade name: NOIGEN TDX, manufactured by DAI- ICHI KOGYO SEIYAKU CO., LTD.) | 0.10 part by mass |
| Ion-exchanqed water | 88.40 parts by mass |

Example 1-6

An ink jet recording medium 1-6 (having a dry coating amount of the protective layer of 0.31 g/m$^2$, including a dry coating amount of the resin particles of 0.01 g/m$^2$; the protective layer had a thickness of 0.30 μm) was obtained in the same manner as in Example 1-1 except that the protective layer coating liquid 1-1 was changed to the following protective layer coating liquid 1-5.

Formulation of Protective Layer Coating Liquid 1-5

The following components were mixed with each other to prepare a protective layer coating liquid 1-5 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 4.36 parts by mass |
| 20 mass % sol of gas phase process silica | 4.36 parts by mass |
| 20 mass % dispersion liquid of resin particles | 0.32 part by mass |
| 8 mass % aqueous solution of polyvinyl alcohol (trade name: PVA-420. manufactured by KURARAY CO., LTD.) | 2.42 parts by mass |
| Surfactant (trade name: NOIGEN TDX, manufactured by DAI- ICHI KOGYO SEIYAKU CO., LTD,) | 0.10 part by mass |
| Ion-exchanged water | 88.45 parts by mass |

Example 1-7

An ink jet recording medium 1-7 (having a dry coating amount of the protective layer of 0.31 g/m$^2$, including a dry coating amount of the resin particles of 0.01 g/m$^2$; the protective layer had a thickness of 0.17 μm) was obtained in the same manner as in Example 1-1 except that the protective layer coating liquid 1-1 was changed to the following protective layer coating liquid 1-6.

Formulation of Protective Layer Coating Liquid 1-6

The following components were mixed with each other to prepare a protective layer coating liquid 1-6 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 8.28 parts by mass |
| 20 mass % sol of gas phase process silica | 0.44 part by mass |
| 20 mass % dispersion liquid of resin particles | 0.32 part by mass |
| 8 mass % aqueous solution of polyvinyl alcohol (trade name: PVA-420, manufactured by KURARAY CO., LTD,) | 2.42 parts by mass |
| Surfactant (trade name: NOIGEN TDX, manufactured by DAI- ICHI KOGYO SEIYAKU CO., LTD.) | 0.10 part by mass |
| Ion-exchanged water | 88.45 parts by mass |

Example 1-8

An ink jet recording medium 1-8 was obtained in the same manner as in Example 1-1 except that the protective layer coating liquid 1-1 was changed to the following protective layer coating liquid 1-7; and the dry coating amount of the protective layer was changed to 1.01 g/m$^2$ (including a dry coating amount of the resin particles of 0.01 g/m$^2$; the protective layer had a thickness of 0.72 μm).

Formulation of Protective Layer Coating Liquid 1-7

The following components were mixed with each other to prepare a protective layer coating liquid 1-7 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.68 parts by mass |
| 20 mass % sol of gas phase process silica | 2.23 parts by mass |
| 20 mass % dispersion liquid of resin particles | 0.10 part by mass |
| 8 mass % aqueous solution of polyvinyl alcohol (trade name: PVA-420, manufactured by KURARAY CO., LTD.) | 2.48 parts by mass |
| Surfactant (trade name: NOIGEN TDX, manufactured by DAI-ICHI KOGYO SEIYAKU CO., LTD.) | 0.10 part by mass |
| Ion-exchanged water | 88.41 parts by mass |

Example 1-9

An ink jet recording medium 1-9 was obtained in the same manner as in Example 1-1 except that the protective layer coating liquid 1-1 was changed to the following protective layer coating liquid 1-8; and the dry coating amount of the protective layer was changed to 0.06 g/m$^2$ (including a dry coating amount of the resin particles of 0.01 g/m$^2$; the protective layer had a thickness of 0.08 μm).

Formulation of Protective Layer Coating Liquid 1-8

The following components were mixed with each other to prepare a protective layer coating liquid 1-8 having a solid content concentration of 2.0 mass %.

| | |
|---|---|
| 20 mass % sol of monodispersed spherical collloidal silica (trade name: SNOWTEX AK-L, manufactured by Nissan Chemical Industries, Ltd.) | 5.63 parts by mass |
| 20 mass % sol of gas phase process silica | 1.88 parts by mass |
| 20 mass % dispersion liquid of resin particles | 1.67 parts by mass |
| 8 mass % aqueous solution of polyviny alcohol (trade name: PVA-420, manufactured by KURARAY CO., LTD,) | 2.08 parts by mass |
| Surfactant (trade name: NOIGEN TDX, manufactured by DAI- ICHI KOGYO SEIYAKU CO., LTD.) | 0.10 part by mass |
| Ion-exchanged water | 88.65 parts by mass |

Example 1-10

An ink jet recording medium 1-10 (the protective layer had a thickness of 0.26 μm) was obtained in the same manner as in Example 1-1 except that, in "Preparation of resin particle dispersion liquid" of Example 1-1, the resin particles were changed to cross-linked polymethyl methacrylate resin particles having an average particle size of 2 μm (trade name: "Techpolymer SSX-102", manufactured by SEKISUI PLASTICS CO., LTD.).

Example 1-11

An ink jet recording medium 1-11 (the protective layer had a thickness of 0.26 μm) was obtained in the same manner as in Example 1-1 except that, in "Preparation of resin particle dispersion liquid" of Example 1-1, the resin particles were changed to cross-linked polymethyl methacrylate resin particles having an average particle size of 27 μm (trade name: "Techpolymer SSX-127", manufactured by SEKISUI PLASTICS CO., LTD.).

Example 1-12

An ink jet recording medium 1-12 (having a dry coating amount of the protective layer of 0.31 g/m$^2$, including a dry coating amount of the resin particles of 0.01 g/m$^2$; the protective layer had a thickness of 0.28 μm) was obtained in the same manner as in Example 1-1 except that the protective layer coating liquid 1-1 was changed to the following protective layer coating liquid 1-9.

Formulation of Protective Layer Coating Liquid 1-9

The following components were mixed with each other to prepare a protective layer coating liquid 1-9 having a solid content concentration of 2.0 mass %.

| | |
|---|---|
| 15 mass % sol of chain colloidal silica (trade name: SNOWTEX ST-OUP, manufactured by Nissan Chemical Industries, Ltd.) | 8.71 parts by mass |
| 20 mass % sol of gas phase process silica | 2.18 parts by mass |
| 20 mass % dispersion liquid of resin particles | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 86.27 parts by mass |

Example 1-13

An ink jet recording medium 1-13 (having a dry coating amount of the protective layer of 0.31 g/m$^2$, including a dry coating amount of the resin particles of 0.01 g/m$^2$; the protective layer had a thickness of 0.25 μm) was obtained in the same manner as in Example 1-1 except that the protective layer coating liquid 1-1 was changed to the following protective layer coating liquid 1-10.

Formulation of Protective Layer Coating Liquid 1-10

The following components were mixed with each other to prepare a protective layer coating liquid 1-10 having a solid content concentration of 2.0 mass %.

| | |
|---|---|
| 15 mass % sol of cluster-shaped colloidal silica (trade name: SNOWTEX ST-HS-M20, manufactured by Nissan Chemical Industries, Ltd.) | 8.71 parts by mass |
| 20 mass % sol of gas phase process silica | 2.18 parts by mass |
| 20 mass % dispersion liquid of resin particles | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 86.27 parts by mass |

Example 1-14

An ink jet recording medium 1-14 (the protective layer had a thickness of 0.26 μm) was obtained in the same manner as in Example 1-1 except that, in "Preparation of resin particle dispersion liquid" of Example 1-1, the resin particles were changed to cross-linked polystyrene resin particles having an average particle size of 6 μm (trade name: "Techpolymer SBX-6", manufactured by SEKISUI PLASTICS CO., LTD.).

Example 1-15

An ink jet recording medium 1-15 (the protective layer had a thickness of 0.26 μm) was obtained in the same manner as in Example 1-1 except that, in "Preparation of resin particle dispersion liquid" of Example 1-1, the resin particles were changed to polyethylene resin particles having an average particle size of 6 μm (trade name: "FLOBEADS LE-1080", manufactured by SUMITOMO SEIKA CHEMICALS CO., LTD.).

Comparative Example 1-1

An ink jet recording medium 1-16 was obtained in the same manner as in Example 1-1 except that the protective layer was not formed.

Comparative Example 1-2

An ink jet recording medium 1-17 was obtained in the same manner as in Example 1-2 except that the protective layer was not formed.

Comparative Example 1-3

An ink jet recording medium 1-18 (having a dry coating amount of the protective layer of 0.31 g/m$^2$, including a dry coating amount of the resin particles of 0.01 g/m$^2$; the protective layer had a thickness of 0.36 μm) was obtained in the same manner as in Example 1-1 except that the protective layer coating liquid 1-1 was changed to the following protective layer coating liquid 1-11.

Formulation of Protective Layer Coating Liquid 1-11

The following components were mixed with each other to prepare a protective layer coating liquid 1-11 having a solid content concentration of 2.0 mass %.

| | |
|---|---|
| 20 mass % sol of gas phase process silica | 8.71 parts by mass |
| 20 mass % dispersion liquid of resin particles | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI- ICHI KOGYO SEIYAKU CO., LTD.) | 0.10 part by mass |
| Ion-exchanged water | 88.45 parts by mass |

Comparative Example 1-4

An ink jet recording medium 1-19 (having a dry coating amount of the protective layer of 0.31 g/m$^2$, including a dry coating amount of the resin particles of 0.01 g/m$^2$; the protective layer had a thickness of 0.19 μm) was obtained in the same manner as in Example 1-1 except that the protective layer coating liquid 1-1 was changed to the following protective layer coating liquid 1-12.

Formulation of Protective Layer Coating Liquid 1-12

The following components were mixed with each other to prepare a protective layer coating liquid 1-12 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 8.71 parts by mass |
| 20 mass % dispersion liquid of resin particles | 0.32 part by mass |
| 8 mass % aqueous solution of polyvinyl alcohol: (trade name PVA-420, manufactured by KURARAY CO., LTD,) | 2.42 parts by mass |
| Surfactant (trade name: NOIGEN TDX, manufactured by DAI- ICHI KOGYO SEIYAKU CO., LTD.) | 0.10 part by mass |
| Ion-exchanged water | 88.45 parts by mass |

Comparative Example 1-5

An ink jet recording medium 1-20 (having a dry coating amount of the protective layer of 0.30 g/m$^2$, including a dry coating amount of the resin particles of 0 g/m$^2$; the protective layer had a thickness of 0.26 μm) was obtained in the same manner as in Example 1-1 except that the protective layer coating liquid 1-1 was changed to the following protective layer coating liquid 1-13.

Formulation of Protective Layer Coating Liquid 1-13

The following components were mixed with each other to prepare a protective layer coating liquid 1-13 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.53 parts by mass |
| 20 mass % sol of gas phase process silica | 2.18 parts by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Comparative Example 1-6

An ink jet recording medium 1-21 (the protective layer had a thickness of 0.26 μm) was obtained in the same manner as in Example 1-1 except that, in "Preparation of resin particle dispersion liquid" of Example 1-1, the resin particles were changed to cross-linked polymethyl methacrylate resin particles having an average particle size of 1 μm (trade name: "Techpolymer SSX-101", manufactured by SEKISUI PLASTICS CO., LTD.).

Comparative Example 1-7

An ink jet recording medium 1-22 (having a dry coating amount of the protective layer of 0.31 g/m$^2$, including a dry coating amount of calcium carbonate particles of 0.01 g/m$^2$; the protective layer had a thickness excluding protrusions formed by calcium carbonate of 0.26 μm) was obtained in the same manner as in Example 1-1 except that in "Preparation of resin particle dispersion liquid" of Example 1-1 calcium carbonate particles having an average particle size of 5 μm (trade name: "BF-200", manufactured by SHIRAISHI CALCIUM KAISHA, LTD.) were used in place of the resin particles.

Example 2-1

An ink jet recording medium 2-1 (having a dry coating amount of the protective layer of 0.31 g/m$^2$, including a dry coating amount of the precipitation process silica particles of 0.01 g/m$^2$) was obtained in the same manner as in Example 1-1 except that the protective layer coating liquid 1-1 was changed to the following protective layer coating liquid 2-1.

Formulation of Protective Layer Coating Liquid 2-1

The following components were mixed with each other to prepare a protective layer coating liquid 2-1 having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.53 parts by mass |
| 20 mass % sol of gas phase process silica | 2.18 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Example 2-2

An ink jet recording medium 2-2 was obtained in the same manner as in Example 2-1 except that the protective layer coating liquid 2-1 was applied not onto the ink-receiving layer of the ink-receiving layer sheet A, but onto the ink-receiving layer of the ink-receiving layer sheet B.

Example 2-3

An ink jet recording medium 2-3 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-2

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 5.81 parts by mass |
| 20 mass % sol of gas phase process silica | 1.94 parts by mass |
| 20 mass % slurry of precipitation process silica particle dispersion liquid | 0.32 part by mass |
| 8 mass % aqueous solution of polyvinyl alcohol (trade name: PVA-420, manufactured, by KURARAY CO., LTD.) | 2.42 parts by mass |
| 25 mass % emulsion of cationic polyurethane (trade name: SUPERFLEX 600, manufactured by DAI-ICHI KOGYO SEIYAKU CO., LTD.) | 0.77 part by mass |
| Surfactant (trade name: NOIGEN TDX, manufactured by DAI-ICHI KOGYO SEIYAKU CO., LTD.) | 0.10 part by mass |
| Ion-exchanged water | 88.64 parts by mass |

Example 2-4

An ink jet recording medium 2-4 (having a dry solid content coating amount of the protective layer of 0.35 g/m$^2$, including 0.05 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-3

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 5.79 parts by mass |
| 20 mass % sol of gas phase process silica | 1.93 parts by mass |
| 20 mass % slurry of precipitation process silica particle dispersion liquid | 1.42 parts by mass |
| 8 mass % aqueous solution of polyvinyl alcohol (trade name: PVA-420, manufactured by KURARAY CO., LTD.) | 2.15 parts by mass |
| Surfactant (trade name: NOIGEN TDX, manufactured by DAI-ICHI KOGYO SEIYAKU CO., LTD.) | 0.10 part by mass |
| Ion-exchanged water | 86.61 parts by mass |

Example 2-5

An ink jet recording medium 2-5 (having a dry solid content coating amount of the protective layer of 0.301 g/m$^2$, including 0.001 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-4

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.73 parts by mass |
| 20 mass % sol of gas phase process silica | 2.24 parts by mass |
| 20 mass % slurry of precipitation process silica particle dispersion liquid | 0.03 part by mass |
| 8 mass % aqueous solution of polyvinyl alcohol (trade name: PVA-420, manufactured by KURARAY CO., LTD.) | 2.49 parts by mass |
| Surfactant (trade name: NOIGEN TDX, manufactured by DAI-ICHI KOGYO SEIYAKU CO., LTD.) | 0.10 part by mass |
| Ion-exchanged water | 88.40 parts by mass |

Example 2-6

An ink jet recording medium 2-6 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-5

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 3.48 parts by mass |
| 20 mass % sol of gas phase process silica | 5.23 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Example 2-7

An ink jet recording medium 2-7 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-6

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 4.36 parts by mass |
| 20 mass % sol of gas phase process silica | 4.36 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name NOIGEN TDX, manufactured by DAI-ICHI KOGYO SEIYAKU CO., LTD.) | 0.10 part by mass |
| Ion-exchanged water | 88.45 parts by mass |

Example 2-8

An ink jet recording medium 2-8 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-7

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 8.28 parts by mass |
| 20 mass % sol of gas phase process silica | 0.44 part by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |

-continued

| | |
|---|---|
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Example 2-9

An ink jet recording medium 2-9 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-8

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 8.54 parts by mass |
| 20 mass % sol of gas phase process silica | 0.17 part by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Example 2-10

An ink jet recording medium 2-10 was obtained in the same manner as in Example 2-1 except that the formulation of the protective layer coating liquid 2-1 was changed to the following formulation; and the coating amount of the protective layer was changed to 1.01 g/m$^2$ in terms of dry solid content coating amount (including 0.01 g/m$^2$ of the precipitation process silica particles).

Formulation of Protective Layer Coating Liquid 2-9

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.68 parts by mass |
| 20 mass % sol of gas phase process silica | 2.23 parts by mass |
| 20 mass % slurry of precipitation process silica particle dispersion liquid | 0.10 part by mass |
| 8 mass % aqueous solution of polyvinyl alcohol (trade name: PVA-420, manufactured by KURARAY CO., LTD.) | 2.48 parts by mass |
| Surfactant (trade name: NOIGEN TDX, manufactured by DAI-ICHI KOGYO SEIYAKU CO., LTD.) | 0.10 part by mass |
| Ion-exchanged water | 88.41 parts by mass |

Example 2-11

An ink jet recording medium 2-11 was obtained in the same manner as in Example 2-1 except that the formulation of the protective layer coating liquid 2-1 was changed to the following formulation, and the coating amount of the protective layer was changed to 0.06 g/m$^2$ in terms of dry solid content coating amount (including 0.01 g/m$^2$ of the precipitation process silica particles).

Formulation of Protective Layer Coating Liquid 2-10

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 6.68 parts by mass |
| 20 mass % sol of gas phase process silica | 2.23 parts by mass |
| 20 mass % slurry of precipitation process silica particle dispersion liquid | 0.10 part by mass |
| 8 mass % aqueous solution of polyvinyl alcohol (trade name: PVA-420, manufactured by KURARAY CO., LTD.) | 2.48 parts by mass |
| Surfactant (trade name: NOIGEN TDX, manufactured by DAI-ICHI KOGYO SEIYAKU CO., LTD.) | 0.10 part by mass |
| Ion-exchanged water | 88.41 parts by mass |

Example 2-12

In "Preparation of colloidal silica sol" of Example 2-1, the colloidal silica particles were changed to colloidal silica having an average primary particle size of 25 nm (trade name: SNOWTEX AK, manufactured by Nissan Chemical Industries, Ltd.). An ink jet recording medium 2-12 was obtained in the same manner as in Example 2-1 except for the foregoing.

Example 2-13

In "Preparation of colloidal silica sol" of Example 2-1, the colloidal silica particles were changed to colloidal silica having an average primary particle size of 90 nm (trade name: CARTACOAT K303C, manufactured by Clariant Co., Ltd.). An ink jet recording medium 2-13 was obtained in the same manner as in Example 2-1 except for the foregoing.

Example 2-14

In "Preparation of gas phase process silica sol" of Example 2-1, the gas phase process silica was changed to gas phase process silica (trade name: AEROSIL 380, manufactured by EVONIK Co.). As a result of particle size measurement by photographing using a scanning electron microscope, the gas phase process silica was found to have an average primary particle size of 7 nm. An ink jet recording medium 2-14 was obtained in the same manner as in Example 2-1 except for the foregoing.

Example 2-15

In "Preparation of gas phase process silica sol" of Example 2-1, the gas phase process silica was changed to gas phase process silica (trade name: AEROSIL 200, manufactured by EVONIK Co.). As a result of particle size measurement by photographing using a scanning electron microscope, the gas phase process silica was found to have an average primary particle size of 13 nm. An ink jet recording medium 2-15 was obtained in the same manner as in Example 2-1 except for the foregoing.

Example 2-16

In "Preparation of precipitation process silica particle dispersion liquid" of Example 2-1, the precipitation process silica particles were changed to precipitation process silica particles having an average secondary particle size of 1.5 μm (trade name: FINESIL T-32, manufactured by Tokuyama Corporation). An ink jet recording medium 2-16 was obtained in the same manner as in Example 2-1 except for the foregoing.

Example 2-17

In "Preparation of precipitation process silica particle dispersion liquid" of Example 2-1, the precipitation process silica particles were changed to precipitation process silica particles having an average secondary particle size of 14 μm (trade name: Nipgel BY-001, manufactured by TOSOH SILICA CORPORATION). An ink jet recording medium 2-17 was obtained in the same manner as in Example 2-1 except for the foregoing.

Example 2-18

An ink jet recording medium 2-18 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-11

The following components were mixed with each other to prepare a protective layer coating liquid having a solid content concentration of 2.0 mass %.

| | |
|---|---|
| 15 mass % sol of chain colloidal silica (trade name: SHOWTEX ST-OUP, manufactured by Nissan Chemical Industries, Ltd.) | 8.71 parts by mass |
| 20 mass % sol of gas phase process silica | 2.18 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 86.27 parts by mass |

Example 2-19

An ink jet recording medium 2-19 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-12

The following components were mixed with each other to prepare a protective layer coating liquid having a solid content concentration of 2.0 mass %.

| | |
|---|---|
| 15 mass % sol of cluster-shaped colloidal silica (trade name: SNOWTEX ST-HS-M20, manufactured by Nissan Chemical Industries, Ltd.) | 8.71 parts by mass |
| 20 mass % sol of gas phase process silica | 2.18 parts by mass |
| 20 mass % slurry of precipitation process silica particle-dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 86.27 parts by mass |

Comparative Example 2-1

An ink jet recording medium 2-20 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-13

The following components were mixed with each other to prepare a protective layer coating liquid having a solid content concentration of 2.0 mass %.

| | |
|---|---|
| 20 mass % sol of gas phase process silica | 8.71 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Comparative Example 2-2

An ink jet recording medium 2-21 (having a dry solid content coating amount of the protective layer of 0.31 g/m$^2$, including 0.01 g/m$^2$ of the precipitation process silica particles) was obtained in the same manner as in Example 2-1 except that the formulation of the protective layer coating liquid 2-1 was changed to the following formulation.

Formulation of Protective Layer Coating Liquid 2-14

The following components were mixed with each other to prepare a protective layer coating liquid having a solid content concentration of 2.0 mass %.

| | |
|---|---|
| 20 mass % sol of monodispersed spherical colloidal silica (trade name: SNOWTEX AK-L, manufactured by Nissan Chemical Industries, Ltd.) | 8.71 parts by mass |
| 20 mass % slurry of precipitation process silica particle dispersion liquid | 0.32 part by mass |
| 8 mass % aqueous solution of polyvinyl alcohol (trade name: PVA-420, manufactured by KURARAY CO., LTD.) | 2.42 parts by mass |
| Surfactant (trade name: NOIGEN TDX, manufactured by DAI-ICHI KOGYO SEIYAKU CO., LTD.) | 0.10 part by mass |
| Ion-exchanged water | 88.45 parts by mass |

Comparative Example 2-3

In "Preparation of precipitation process silica particle dispersion liquid" of Example 2-1, the prepared precipitation process silica particle dispersion liquid was further subjected to dispersion treatment with a bead mill (zirconia beads having a diameter of 0.3 mm) so as to have an average secondary particle size of 0.8 μm. An ink jet recording medium 2-22 (having a dry solid content coating amount of the protective layer of 0.31 g/m$^2$, including 0.01 g/m$^2$ of the precipitation process silica particles) was obtained in the same manner as in Example 2-1 except for the foregoing.

Comparative Example 2-4

In "Preparation of precipitation process silica particle dispersion liquid" of Example 2-1, the precipitation process silica particles were changed to calcium carbonate particles having an average particle size of 5.0 μm (trade name: BF-200, manufactured by SHIRAISHI CALCIUM KAISHA, LTD.). An ink jet recording medium 2-23 (having a dry solid content coating amount of the protective layer of 0.31 g/m$^2$, including 0.01 g/m$^2$ of calcium carbonate particles) was obtained in the same manner as in Example 2-1 except for the foregoing.

Evaluation

Next, each of the recording media 1-1 to 1-22 and 2-1 to 2-23 obtained in Examples and Comparative Examples above was subjected to the following evaluations. Table 1 shows evaluation results. Evaluation methods and evaluation criteria are as described below.

Ink Absorbency

The ink absorbency of each of the recording media was evaluated. Printing on a recording surface was performed using an apparatus obtained by modifying the printing processing method of "iP4600" (trade name, manufactured by Canon Inc.). Evaluation was made by using, as a printing pattern, a solid green color having a 64-step gradation (64-step gradation in increments of a duty of 6.25%, duties of from 0 to 400%); and performing bidirectional printing in which printing was completed after conducting a back-and-forth path twice, i.e., a going path and a return path, at a carriage speed of 25 inches/second. It should be noted that a duty of 400% means that 44 ng of ink is applied to a square of 600 dpi (a 1-inch square with 600 dpi). The ink absorbency has a substantial correlation with beading. Accordingly, the ink absorbency of the recording medium was evaluated through the evaluation of the beading. The evaluation was performed by visual observation based on the following evaluation criteria.

Evaluation Criteria

5: No beading was observed at a duty of 300%.

4: Slight beading was observed at a duty of 300%, but no beading was observed at a duty of 250%.

3: Slight beading was observed at a duty of 250%, but no beading was observed at a duty of 200%.

2: Slight beading was observed at a duty of 200%, but no beading was observed at a duty of 150%.

1: Beading was observed even at a duty of 150%.

Color Developability of Image to be Obtained

Solid printing of a black patch was performed on the recording surface of each of the recording media using an ink jet recording apparatus (trade name: "iP4500", manufactured by Canon Inc.) in the mode of Super Photo Paper and no color correction. An optical density was measured for each of the recording media using an optical reflection densitometer (manufactured by X-Rite Co., trade name: 530 spectrodensitometer), and the color developability of an image to be obtained was evaluated based on the following criteria.

Evaluation Criteria

5: The optical density was 2.35 or more.

4: The optical density was 2.25 or more and less than 2.35.

3: The optical density was 2.15 or more and less than 2.25.

2: The optical density was 2.05 or more and less than 2.15.

1: The optical density was less than 2.05.

Scratch Resistance

Each of the recording media was evaluated for its scratch resistance as described below using a Gakushin-Type Rubbing Tester Model II (manufactured by TESTER SANGYO CO., LTD.) specified in JIS-L0849.

The recording medium was set on a vibrating table as a sample piece so that the recording surface side faced upward. "KIMTOWEL" (trade name) was mounted on a friction arm of the tester having placed thereon a 100-g weight, and was rubbed against the recording surface of the recording medium five times. After that, a difference in 75° gloss between the part of the recording surface of the recording medium rubbed with the "KIMTOWEL", and another part thereof was measured. As an apparatus for measuring the gloss, "VG2000" (trade name) manufactured by NIPPON DENSHOKU INDUSTRIES CO., LTD. was used.

Evaluation Criteria

5: The gloss difference was less than 5.

4: The gloss difference was 5 or more and less than 10.

3: The gloss difference was 10 or more and less than 15.

2: The gloss difference was 15 or more and less than 20.

1: The gloss difference was 20 or more.

TABLE 1

| Evaluation results | | | | | | |
|---|---|---|---|---|---|---|
| | | Protective layer | | Evaluation results | | |
| Example No. | Recording medium No. | Content of colloidal silica/content of gas phase process silica (times) | Dry coating amount of protective layer (g/m$^2$) | Ink absorbency | Color developability of image to be obtained | Scratch resistance |
| Example 1-1 | Recording medium 1-1 | 3.00 | 0.310 | 5 | 5 | 5 |
| Example 1-2 | Recording medium 1-2 | 3.00 | 0.310 | 5 | 5 | 4 |
| Example 1-3 | Recording medium 1-3 | 3.00 | 0.310 | 5 | 5 | 5 |
| Example 1-4 | Recording medium 1-4 | 3.00 | 0.350 | 5 | 4 | 5 |
| Example 1-5 | Recording medium 1-5 | 3.00 | 0.301 | 5 | 5 | 3 |
| Example 1-6 | Recording medium 1-6 | 1.00 | 0.310 | 5 | 5 | 3 |
| Example 1-7 | Recording medium 1-7 | 18.00 | 0.310 | 3 | 3 | 5 |
| Example 1-8 | Recording medium 1-8 | 3.00 | 1.010 | 3 | 3 | 5 |

TABLE 1-continued

| Evaluation results | | | | | | |
|---|---|---|---|---|---|---|
| | | Protective layer | | Evaluation results | | |
| Example No. | Recording medium No. | Content of colloidal silica/content of gas phase process silica (times) | Dry coating amount of protective layer (g/m$^2$) | Ink absorbency | Color developability of image to be obtained | Scratch resistance |
| Example 1-9 | Recording medium 1-9 | 3.00 | 0.060 | 5 | 5 | 3 |
| Example 1-10 | Recording medium 1-10 | 3.00 | 0.310 | 5 | 5 | 3 |
| Example 1-11 | Recording medium 1-11 | 3.00 | 0.310 | 5 | 5 | 5 |
| Example 1-12 | Recording medium 1-12 | 3.00 | 0.310 | 5 | 3 | 3 |
| Example 1-13 | Recording medium 1-13 | 3.00 | 0.310 | 5 | 3 | 3 |
| Example 1-14 | Recording medium 1-14 | 3.00 | 0.310 | 5 | 5 | 5 |
| Example 1-15 | Recording medium 1-15 | 3.00 | 0.310 | 5 | 3 | 3 |
| Comparative Example 1-1 | Recording medium 1-16 | — | — | 5 | 5 | 2 |
| Comparative Example 1-2 | Recording medium 1-17 | — | — | 5 | 5 | 1 |
| Comparative Example 1-3 | Recording medium 1-13 | 0 | 0.310 | 5 | 5 | 2 |
| Comparative Example 1-4 | Recording medium 1-19 | — | 0.310 | 1 | 2 | 5 |
| Comparative Example 1-5 | Recording medium 1-20 | 3.00 | 0.300 | 5 | 5 | 2 |
| Comparative Example 1-6 | Recording medium 1-21 | 3.00 | 0.310 | 5 | 5 | 2 |
| Comparative Example 1-7 | Recording medium 1-22 | 3.00 | 0.310 | 5 | 1 | 4 |
| Example 2-1 | Recording medium 2-1 | 3.00 | 0.310 | 5 | 5 | 5 |
| Example 2-2 | Recording medium 2-2 | 3.00 | 0.310 | 5 | 5 | 4 |
| Example 2-3 | Recording medium 2-3 | 3.00 | 0.310 | 5 | 5 | 5 |
| Example 2-4 | Recording medium 2-4 | 3.00 | 0.350 | 5 | 4 | 5 |
| Example 2-5 | Recording medium 2-5 | 3.00 | 0.301 | 5 | 5 | 3 |
| Example 2-6 | Recording medium 2-6 | 3.00 | 0.310 | 5 | 5 | 3 |
| Example 2-7 | Recording medium 2-7 | 3.00 | 0.310 | 5 | 5 | 3 |
| Example 2-8 | Recording medium 2-8 | 0.67 | 0.310 | 4 | 4 | 5 |
| Example 2-9 | Recording medium 2-9 | 1.00 | 0.310 | 3 | 4 | 5 |
| Example 2-10 | Recording medium 2-10 | 18.00 | 1.010 | 3 | 3 | 5 |
| Example 2-11 | Recording medium 2-11 | 49.00 | 0.060 | 5 | 5 | 3 |
| Example 2-12 | Recording medium 2-12 | 3.00 | 0.310 | 5 | 5 | 5 |
| Example 2-13 | Recording medium 2-13 | 3.00 | 0.310 | 5 | 4 | 5 |
| Example 2-14 | Recording medium 2-14 | 3.00 | 0.310 | 3 | 5 | 5 |
| Example 2-15 | Recording medium 2-15 | 3.00 | 0.310 | 5 | 3 | 5 |
| Example 2-16 | Recording medium 2-16 | 3.00 | 0.310 | 5 | 5 | 3 |
| Example 2-17 | Recording medium 2-17 | 3.00 | 0.310 | 5 | 3 | 5 |
| Example 2-18 | Recording medium 2-18 | 3.00 | 0.310 | 5 | 3 | 3 |
| Example 2-19 | Recording medium 2-19 | 3.00 | 0.310 | 5 | 3 | 3 |
| Comparative Example 2-1 | Recording medium 2-20 | 0 | 0.310 | 5 | 5 | 2 |
| Comparative Example 2-2 | Recording medium 2-21 | — | 0.310 | 1 | 2 | 5 |
| Comparative Example 2-3 | Recording medium 2-22 | 3.00 | 0.310 | 5 | 5 | 2 |
| Comparative Example 2-4 | Recording medium 2-23 | 3.00 | 0.310 | 5 | 1 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-265293, filed Dec. 24, 2013, and No. 2014-124453, filed Jun. 17, 2014, which are hereby incorporated by reference herein in their entirety.

What is claimed is:

1. A recording medium comprising, in the following order:

a base;

an ink-receiving layer containing inorganic particles; and a protective layer, wherein the protective layer includes:

(a) monodispersed spherical colloidal silica;

(b) gas phase process silica; and (c) at least one kind of particles selected from crosslinked thermoplastic resin particles and wet process silica particles, wherein an average particle size of the at least one kind of particles is 1.5 μm or more, wherein a content of the monodispersed spherical colloidal silica in the protective layer is 0.67 times or more and 3.00 times or less as much as a content of the gas phase process silica in terms of mass ratio, and wherein a dry coating amount of the protective layer is 0.060 g/m$^2$ or more and 0.310 g/m$^2$ or less.

2. A recording medium according to claim 1, wherein an average primary particle size of the monodispersed spherical colloidal silica is 20 nm or more and 100 nm or less.

3. A recording medium according to claim 1, wherein an average primary particle size of the gas phase process silica is 3 nm or more and less than 20 nm.

4. A recording medium according to claim 1, wherein a dry coating amount of the at least one kind of particles contained in the protective layer is 0.001 g/m$^2$ or more and 0.05 g/m$^2$ or less.

5. A recording medium according to claim 1, wherein the protective layer further contains polyvinyl alcohol.

6. A recording medium according to claim 5, wherein a content of the polyvinyl alcohol in the protective layer is 3 mass % or more and 40 mass % or less with respect to a total content of the monodispersed spherical colloidal silica and the gas phase process silica.

7. A recording medium according to claim 1, wherein the crosslinked thermoplastic resin particles are crosslinked polymethyl methacrylate resin particles.

* * * * *